US005483707A

United States Patent [19]

Meyer et al.

[11] Patent Number: 5,483,707

[45] Date of Patent: Jan. 16, 1996

[54] SELF STANDING SUPPORT STRUCTURE AND METHOD

[76] Inventors: Douglas S. Meyer; Fred M. Meyer; Michelle D. Meyer, all of 4016 Highway 34, Wheatland, Wyo. 82201

[21] Appl. No.: 24,322

[22] Filed: Mar. 1, 1993

[51] Int. Cl.[6] ..... A47C 19/00; A47C 19/20; A47C 17/84

[52] U.S. Cl. ..... 5/9.1; 5/8

[58] Field of Search ..... 5/9.1, 8, 10.1

[56] References Cited

U.S. PATENT DOCUMENTS

| | | | |
|---|---|---|---|
| 640,782 | 1/1900 | Lein | 5/9.1 |
| 1,284,821 | 11/1918 | Travis | 5/9.1 |
| 1,349,962 | 8/1920 | Janson et al. | 5/9.1 |
| 1,459,826 | 6/1923 | Gosso | 5/9.1 |
| 2,276,998 | 3/1942 | Stollenwerk | 5/9.1 |
| 3,748,667 | 7/1973 | Ract | 5/9.1 |
| 5,150,484 | 9/1992 | Whitten, Jr. | 5/9.1 |
| 5,263,210 | 11/1993 | Pollard | 5/9.1 |

FOREIGN PATENT DOCUMENTS

| | | |
|---|---|---|
| 1654268 | 4/1971 | Germany . |
| 591227 | 9/1977 | Switzerland . |

*Primary Examiner*—Alexander Grosz
*Attorney, Agent, or Firm*—Frank P. Grassler

[57] ABSTRACT

A self standing supporting structure and method for use in providing sleeping and/or resting accommodations in a limited space area such as in a college dormitory, a medical institution, a prison and in other areas. The structure is designed to support at least one bed and/or other accommodation device in at least two positions, one position being a "non-use position and the other position being a "use" position. The bed and/or other accommodation devices are pivotally mounted on the supporting structure and are retained in the desired position by at least one retaining device. The structure may also be constructed with adjustable feature to make the width of the device shorter as desired to facilitate the cleaning and/or painting of walls in the space area adjacent to the device. Also disclosed is a novel safety lock retainer device for retaining the bed in a horizontal position and a novel method for providing sleeping and/or resting accommodations in a limited space area using the applicant's supporting structure.

21 Claims, 3 Drawing Sheets

SELF STANDING SUPPORT STRUCTURE AND METHOD

BACKGROUND OF THE INVENTION

This invention relates generally to a device for providing additional sleeping and or resting accommodations such as a bed in a limited space area and in particular relates to a new and novel self-standing supporting structure having novel features that permit the accommodation to be retracted when not in use to thereby provide maximum room space in the area.

In college and university dormitories, the space area assigned to a student in the dormitory is usually very limited. For example, a typical dormitory space allocated to sleeping accommodations may be as small as 8 feet by 12 feet. Since a college student may want to have a bed, a couch, a chair, a refrigerator and other items in the limited dormitory space area, the extremely cramped space can present problems.

In many penal institutions and hospitals, a problem can occur in providing overflow sleeping and/or resting accommodations for the inhabitants of the building during critical times of emergencies when limited beds are available. In a similar manner, during weather emergencies, towns and communities are often required to provide temporary sleeping accommodations in school gymnasiums and other areas for lengthy periods of time. These emergency situations may have to continue until the town can recover from the emergency and the occupants can get back to their homes which sometimes may have to be rebuilt.

Prior art devices of the type conceived by the applicants' are not known to be available to solve the problems of providing temporary sleeping and or resting accommodations in limited space areas such as the before mentioned dormitories, penal institutions, hospitals and other places where quick and temporary solutions are desired.

It is always possible to hang beds from the walls or the ceilings of an area using brackets attached to the walls and ceilings. But the use of attached brackets for hanging the temporary sleeping accommodations is not desirable in most cases. Since the wall and ceiling bracket attachment would have to be removed after the temporary overcrowding or emergency condition had ended, the removal of the attachments may often require extensive patching of the walls and ceiling where the brackets were fastened. The initial set-up and after removal costs of restoring the area can be costly and such solution does not appear to be a viable alternative to the applicant's solution to the problem as will be shown hereafter.

The use of permanent bunk bed frames for temporary accommodations may not be a very practical alternative either since permanent bunk beds are generally formed of a welded construction which makes their storage, after the need for the temporary use is over, very difficult because the beds can not readily be broken down for storage.

SUMMARY OF THE INVENTION

In order to overcome the problems inherent in prior art sleeping and resting accommodations, there is provided by the subject invention, a solution to the problem. The applicant's novel design with it's unique features provides a self-standing supporting structure that may be easily assembled and disassembled by bolts and nuts using only a wrench. The supporting structure is designed to be assembled on-site and is designed to be positioned in the limited space area without attaching the structure to the walls or the ceiling of the area.

The applicant's self-standing supporting structure extends across the room and provides support for at least one bed and/or other accommodation device such as a couch. The bed and/or other accommodation device is designed to be pivoted from the supporting structure which has a generally horizontal support means, and at least three downwardly positioned legs that are positioned on the floor. The accommodation devices may be pivoted downwardly to a "use" position when desired. Thereafter, they may be pivoted upwardly to a "non-use" position where they are retained until a further "use" condition is desired for the device. The process may then be repeated as needed by the user of the device.

In the preferred embodiment shown in the drawings, the applicant's unique design has at least one retaining means attached to the bed frame for retaining the bed frame in the horizontal "use" position. The novel design also may have several retaining means such as chains or safety locks incorporated into the design to add additional safety features. In the design shown in the drawings, the embodiment shown has a pair of chains as well as a pair of safety locks on the bed frame which serve as retaining means to hold the bed in a horizontal "use" position.

The unique self-standing supporting structure may then be used to hold one or more beds and other accommodation devices to improve the space utilization in the area. The added space gained by the use of the applicant's novel device may then be used to hold other furniture such as sofas, chairs, refrigerators and the like.

The unique design concept may also be constructed in various modifications with features that permit the structure to be compressed to facilitate painting or cleaning of walls in the limited space area.

Accordingly one object and advantage of the invention is to provide a new and novel device that may be used to increase the space utilization of a limited space area.

A further object and advantage of the applicant's invention is to provide a self-supporting structure for retaining a bed and/or other accommodation devices, with the structure being easily assembled and broken down and also being one that does not require attachment to existing walls, ceilings or floors.

Another object and advantage of the applicant's invention is to provide a self-standing structure that provides adjustable bed positions and bed accommodations which may be from one to six or more accommodations depending upon the size of the structure.

Still another object and advantage of the applicant's invention is to provide a self-standing structure that may be constructed so that it is adjustable and will fit within the width of various space areas Yet another object and advantage of the subject invention is to provide a design that may be made adjustable so that it may be compressed in size to permit the structure to be moved away from the walls in the limited space area in order to facilitate painting or cleaning of walls.

DESCRIPTION OF THE PREFERRED EMBODIMENT

Figure 1:
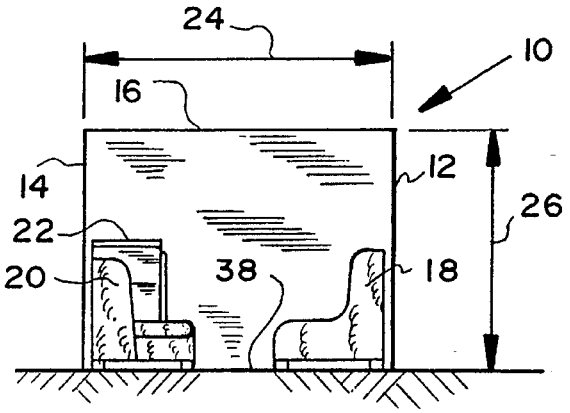
FIG. 1 (PRIOR ART)
FIG. 1 is a side view of a typical limited space area, such as a college dormitory room, showing common items that may be included in a student dormitory space area.

Referring now to the drawings in general and in particular to FIG. 1 of the drawings, there is shown a side view of a typical prior art limited space area generally by the numeral 10. The limited space area could be a college dormitory room or some other area. The room would comprise a pair of opposite walls 12 and 14 and a ceiling 16 and may contain a couch 18 as well as a chair 20 and a refrigerator 22 as shown.

A typical dormitory room may have a width, as shown by the numeral 24 of twelve feet more or less. The typical room may also have a height, shown by the numeral 26 of eight feet more or less. It can be seen in the prior art space area 10 of FIG. 1 how the addition of more sleeping and/or resting accommodations in the cramped area 10 would be difficult to obtain without providing some novel solution to the problem.

Figure 2:
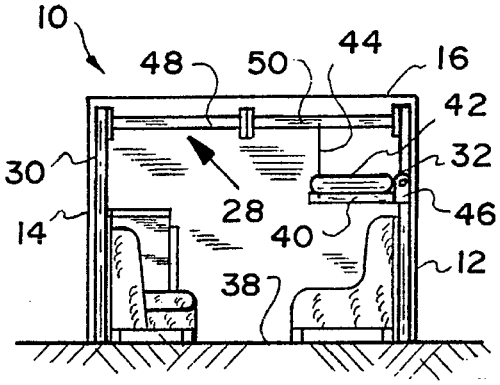
FIG. 2 is a side view, similar to the view of FIG. 1, showing the applicant's new and novel self-standing support structure which is designed to provide additional resting and/or sleeping accommodations in the limited space area.

Turning now to FIG. 2 of the drawings, there is shown the applicant's unique self-standing support structure generally by the numeral 28. The structure 28 is assembled at the site with bolts and nuts as well as a crescent wrench and is positioned as shown so that it can stand in close proximity to the walls 12 and 14 and can span across the room beneath the ceiling 16. The support structure 28 in the preferred embodiment has a pair of downwardly positioned legs 30 and 32 as well as the legs 34 and 36 which can be seen in FIG. 3 of the drawings. These legs 30, 32, 34 and 36 will rest on the floor 38 of the limited space area 10 as shown. No attachments are required to the existing walls 12, 14, the ceiling 16 or to the floor 38 in order to use the novel device.

Figure 3:
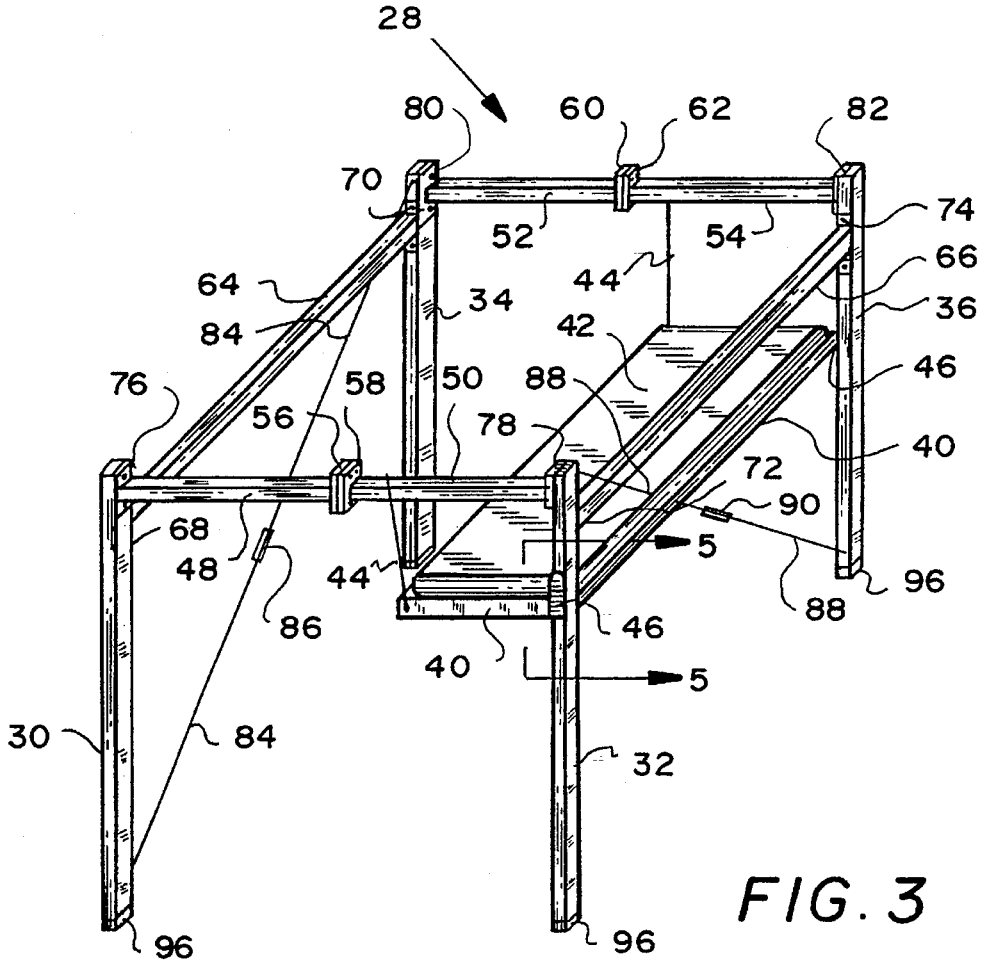
FIG. 3 is a perspective view of the preferred embodiment of the applicant's self-standing support structure shown in FIG. 2 of the drawings, looking down at the structure, and showing one pivotally mounted bed frame and mattress being supported by the support structure.

Referring now to FIG. 3 as well as to FIG. 2 of the drawings, there is shown in FIG. 3, a perspective view of the preferred embodiment of the applicant's self-standing support structure 28. In FIGS. 2 and 3, there is shown one bed frame 40 having a mattress 42 positioned on top of the bed frame 40. The bed frame 40 is pivotally mounted as will be described in later drawing views. The pivotally mounted bed frame 40 permits the bed frame 40 and mattress 42 to be pivoted upwardly to a "non-use" position and to be pivoted downwardly to a "use" position as desired. The bed frame 40 also may be retained in the "non-use" position as will be described later.

The preferred embodiment of the applicant's unique structure contains a pair of retaining means in the form of the chains 44 which are used to hold the bed frame 40 in the horizontal "use" position. The chain retaining means 44 are designed to hold the entire weight of the bed frame 40, the mattress 42 as well as the weight of one or more persons that may sit or lie on the bed. The same chains 44 are also used to hold the bed frame in the "non-use" position as will be explained hereinafter.

As an added safety feature, the preferred embodiment shown also contains another retaining means 46 in the form of a pair of safety locks on each end of the bed frame 40. These safety locks will be described hereinafter when referring to FIGS. 5 and 6 of the drawings. They serve to prevent the bed frame 40 from pivoting below the horizontal "use" position. The retaining means safety locks 46 also are designed to hold the entire weight of the bed frame 40, the mattress 42 as well as the weight of one or more persons that may sit or lie on the mattress while the bed frame 40 is in the "use" position.

When constructed thusly, the applicant's novel supporting structure 28 has a safety factor of safety since each pair of retaining means chains 44 as well as each pair of retaining means safety locks 46 can hold the entire designed weight of occupants as well as the frame 40 and mattress 42.

The preferred embodiment shown in FIG. 3 is designed with cross supports 48 and 50 as well as cross supports 52 and 54. These supports are bolted to each other as shown by the flanges 56 and 58 as well as the flanges 60 and 62. The supporting structure 28 has a pair of elongated supports 64 and 66 which are bolted to the legs 30, 32, 34 and 36 by the flanges 68, 70, 72, and 74 as shown. The cross supports 48, 50, 52 and 54 are also bolted to the legs 30, 32, 34, and 36 by flanges 76, 78, 80, and 82 as shown.

The bolted construction shown provides an easily assembled structure that may also be quickly disassembled at the site for storage as desired. The structure 28 also uses a pair of cables 84 which are attached to the legs 30, and 34 by known attaching means. In a similar manner, the structure 28 uses a pair of cables 88 which are attached to the legs 32 and 36 by known attaching means. The turnbuckles 86 and 90 are used to tighten these cables to thereby provide the cross-bracing for the structure as shown in FIG. 3 of the drawings.

Figure 4:
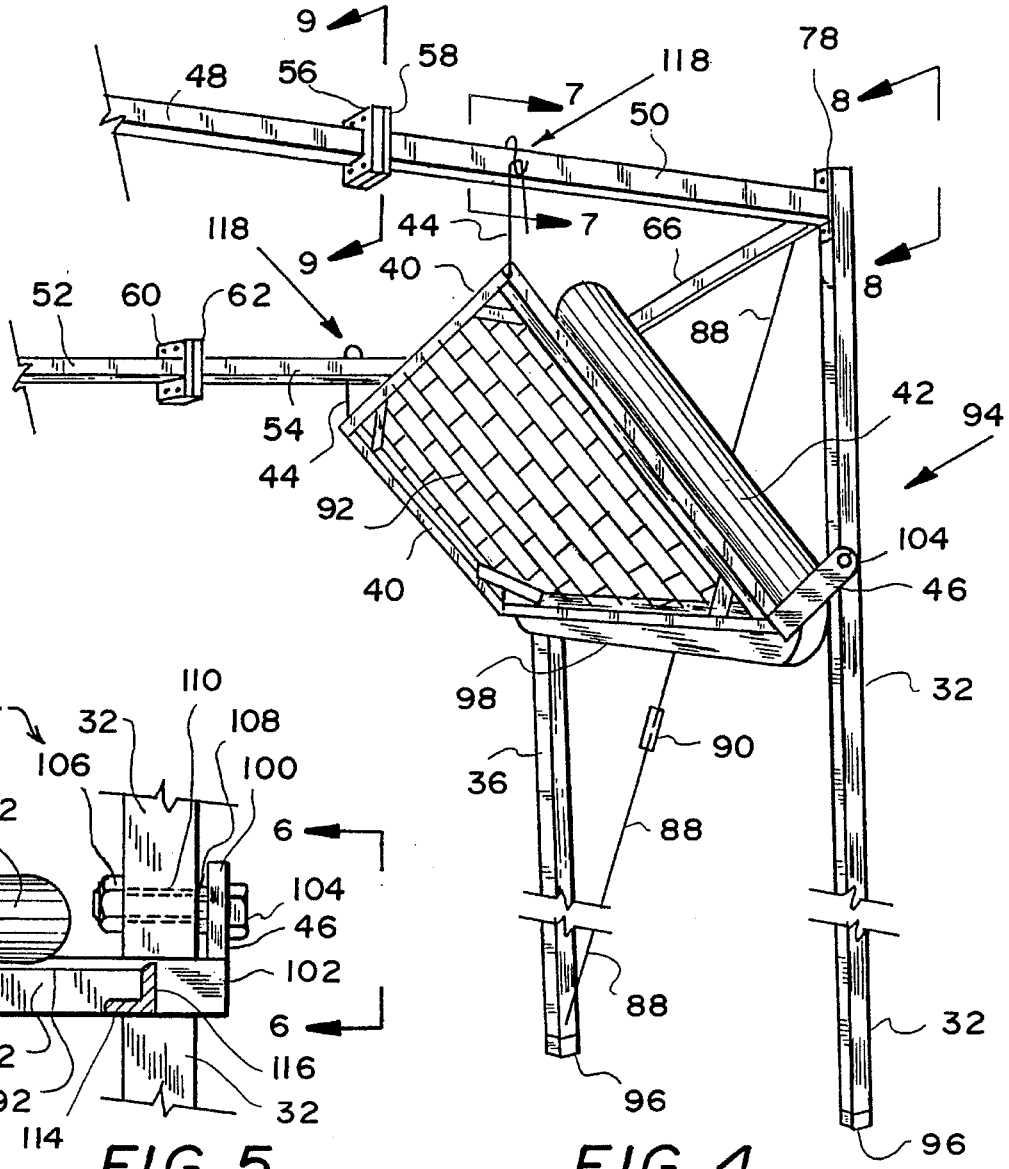
FIG. 4 is another perspective view, taken from a position looking upwardly at the novel support structure, showing the bed frame pivoted upwardly into a "non-use" position.

Referring now to FIG. 4 of the drawings, there is shown another perspective view, taken from a position looking upwardly at the novel structure. In FIG. 4, the bed frame 40 is shown pivoted upwardly to the "non-use" position and may be held in this position by the chains 44. A pivot connection 94 on each of the safety locks 46, permits the bed frame 40 to pivot as shown. When in the position shown in FIG. 4 of the drawings, the mattress 42 can slide on the bed frame springs 92 as shown until the edge 98 of the mattress hits the wall 12 and is retained there. When the supporting structure would be used in an open area such as a gymnasium, then a mattress stop could be utilized on the bed frame to keep the mattress from sliding off of the bed springs 92.

The bottom of the downwardly positioned legs 30, 32, 34, and 36 contain leg pads 96 to prevent marking or scratching of the floor 38 on which the device stands. The holding of the bed in the upwardly positioned "non-use" position by the cables 44 will be described hereafter when referring to FIG. 7 of the drawings.

Figure 5:
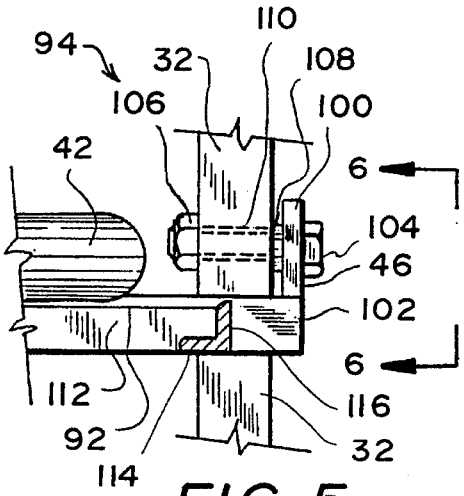
FIG. 5 is a cross sectional view, taken along lines 5—5 of FIG. 3, showing in detail one of the retaining means for retaining the bed frame and mattress in a horizontal "use" position for the bed.
Figure 6:
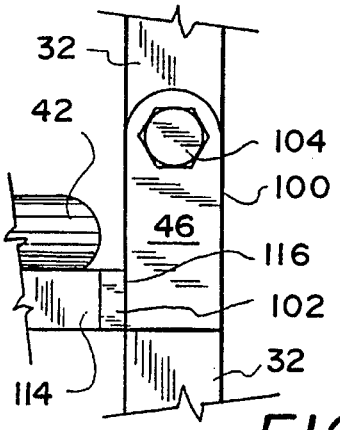
FIG. 6 is a side view, taken along lines 6—6 of FIG. 5 showing in more detail the retainer means of FIG. 5 of the applicant's invention.

Turning now to FIGS. 5 and 6 of the drawings, there is shown in FIG. 5, a cross sectional view, taken along lines 5—5 of FIG. 3. This view shows in detail one of the retaining means for retaining the bed frame in the horizontal "use" position. The retaining means shown in FIGS. 5 and 6 also act as a safety lock feature that prevents the bed frame 40 from falling below the horizontal position as has been described before.

The safety lock feature is incorporated into the pivot connection 94 on the legs 32 and 36. A first plate 100, having an upper end and a lower end is welded to a second plate 102 as shown to form the safety lock feature on the device. The second plate 102 is positioned approximately perpendicular to the first plate 100. The second plate 102 of each safety lock extends partly across the legs 32 and 36.

The first plate 100 has a hole (not shown) formed in the upper portion of the plate and the legs 32 and 36 have a matching hole 110 formed through the legs as shown in FIG. 5 of the drawings. A bolt 104 at each leg 32 and 36 is positioned in the holes formed in the first plate 100 at each leg 32 and 36 and through the washers 108 as well as in the holes 110 in the legs 32 and 36. A nut 106 is then used on each safety lock to hold the pivot connection 94 for the bed together as shown in FIG. 5 of the drawings. The rear angle 112 as well as the side angles 114 of the bed frame 40 are welded at 116 to each of the two pivot connections 90 to rigidly attach the bed frame 40 to the pivot connections 94 so that the bed 40 may pivot as desired.

Referring now to FIG. 6 of the drawings, there is shown a side view, taken along lines 6—6 of FIG. 5 showing in more detail the pivot connection 94 or the bed frame 40 of the applicant's device. While the particular pivot connection design is shown, it is within the spirit and scope of the applicant's invention that other pivot connections and safety lock retainer means can be used and the applicant's are not to be limited to the particular design shown which has been given by way of illustration only.

Figure 7:
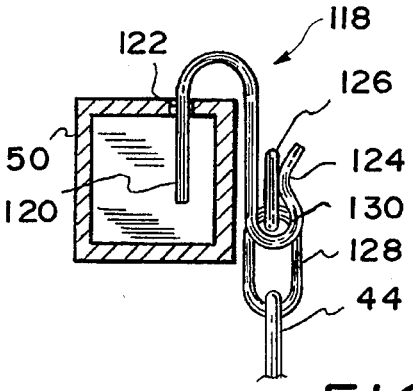
FIG. 7 is a cross sectional view, taken along lines 7—7 of FIG. 4 showing in detail the locking device for rigidly holding the other retainer means, such as a chain, in a desired position so that the bed frame can be positioned either in a horizontal "use" position or in a upwardly positioned "non-use" position such as shown in FIG. 4 of the drawings.

Referring now to FIG. 7 as well as to FIGS. 3 and 4, there will be described in detail the manner of retaining the bed frame 40 in a desired position, either upwardly in the "non-use" position as shown in FIG. 4 or horizontally in the "use" position as can be seen in FIG. 3 of the drawings. As before described, one of the retaining means for the novel structure 28 may be a pair of chains 44 which would be attached at the lower end of each chain 44 to the bed frame 40 by means known in the attaching art such as with bolts or a welded connection.

The upper end of the chains 44 may be used to hold the bed frame 40 in the desired position by a pair of chain locks, shown generally by the numeral 118, which are formed in the shape as shown in FIG. 7. The chain lock 118 has a straight portion 120 which is positioned in a hole 122 in the top of the cross supports 50 and 54. The chain lock 118 also has a hook shape curved portion 124 as shown, which is designed to receive one link 126 of the chain 43 in the hook space 130. When positioned in this manner, the link 128 on one side of the link 126 as well as the link (not shown) on the other side of the link 126 can not move. As a result, the chain lock 118 may be used to hold the bed frame 40 in a desired "use" or "non-use" position by moving the chain links in the hooked portion 124 to the appropriate position. Other means of holding the bed frame 40 and the chains 44 in a desired position may be used within the spirit and scope of the applicant's invention.

Figure 8:
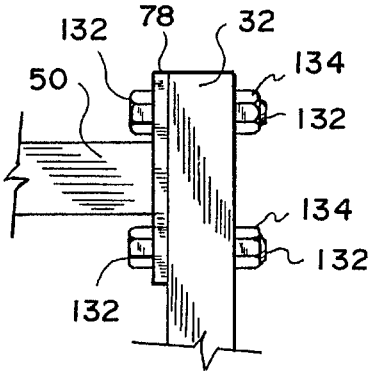
FIG. 8 is a side view, taken along lines 8—8 of FIG. 4, showing in detail a typical flange connection used on the applicant's novel support structure that is used to make the entire support structure easily assembled or disassembled in the field.
Figure 9:
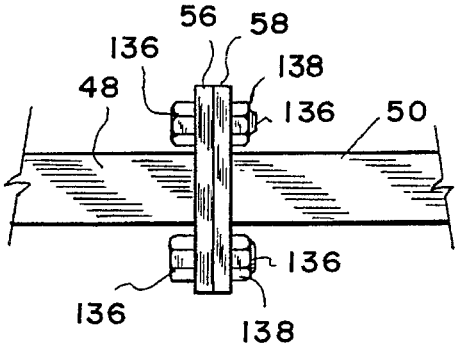
FIG. 9 is a side view, taken along lines 9—9 of FIG. 4 showing in more detail the flange connections used on the cross supports of the support structure in the preferred embodiment.

Referring now to FIGS. 8 and 9 of the drawings, there is shown the bolted connections for bolting the cross supports 48 and 50 as well as the cross supports 52 and 54 to their respective legs 30, 32, 34 and 36 as previously described. A pair of bolts 132 are positioned in holes formed in the flanges 76, 78, 80, and 82 and in holes (not shown) formed in the legs 30, 32, 34, and 36. These holes are not shown in FIG. 8 and a pair of nuts 134 are used at each connection on the bolts 132 to tightly hold the connection together thereby making assembly and disassembly of the structure relatively quick and extremely easy.

Figure 10:
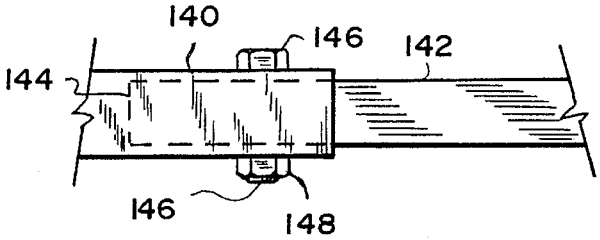
FIG. 10 is a side view, similar to the view of FIG. 9, showing a modification of the cross supports used in the applicant's invention and showing in detail how the cross supports could be constructed as an expandable support to accommodate variations in the width of the space area.

In a similar manner, the cross supports 48 and 50 as well as the cross supports 52 and 54 are connected together at the flanges 56, 58, 60 and 62 as shown in FIG. 3 and as represented in FIG. 9 of the drawings using the bolts 136 and the nuts 138 as shown. If it is desired to make the cross supports 48, 50, 52 and 54 adjustable, then they may be designed as shown in FIG. 10 of the drawings. This adjustable modification of the cross supports would use a larger support 140 with a smaller support 142 partly positioned inside therein as shown by the dotted line 144. A bolt 146 could then be positioned through the appropriate holes (not shown) in the supports 140 and 142 and could be attached to the nut 148 to tightly hold the modified cross supports 140 and 142 together.

In place of the nut and bolt design, there could be used a spring loaded pin of the type commonly used in the adjustable connection art within the spirit and scope of the invention. The applicant is not to be limited to the type of adjustable connection shown which is given only by way of illustration.

Figure 11:
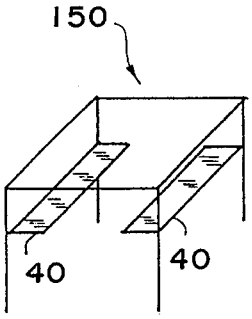
FIGS. 11–13 are diagrammatic representations of modifications of the applicant's basic invention showing two bed frames used in FIG. 11, four bed frames used in FIG. 12 and six bed frames used in FIG. 13 on the novel support structure.
Figure 12:
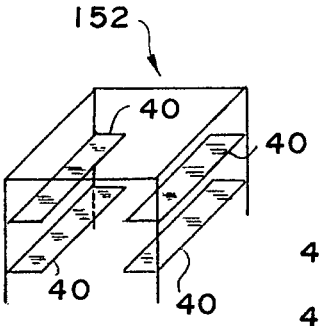
Figure 13:
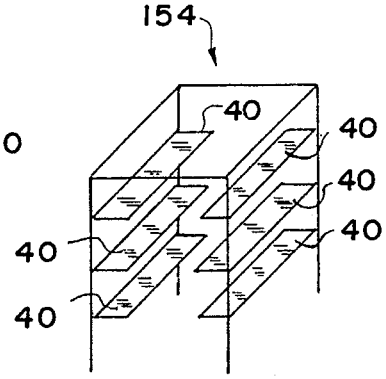

Referring now to FIGS. 11–13 of the drawings, there are shown diagrammatic representations of modifications of the applicant's basic invention. In FIG. 11, the novel modified structure 150 could be designed to hold two beds 40 positioned across from each other as shown. The two beds 40 could also be positioned one above the other within the spirit of the applicant's invention or in alternate up and down positions on the frame structure 150.

FIG. 12 shows another modified structure 152 where four beds 40 are used as shown with two beds 40 positioned on each side of the structure. FIG. 13 shows another modified structure 154 which uses six beds 40 positioned with three beds 40 on each side of a taller supporting structure. It should be apparent that other combinations of the bed arrangements on the frame structures may be used. These other combinations are considered to be within the spirit and scope of the applicant's invention and the applicant's are not to be limited to the arrangements shown in FIGS. 11—13 which are illustrative only.

In addition to the arrangements shown using a bed 40 or a plurality of beds 40, the unique device may also be designed with other types of pivoted accommodation devices such as chairs, couches and others within the spirit and scope of the applicant's invention. In addition, the unique structure shown may be designed to receive and hold various other attachments that the college student or other user may desire.

Figure 14:
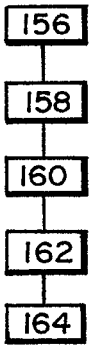
FIG. 14 is a diagrammatic representation of the steps of the applicant's novel method for providing resting and/or sleeping accommodations in a limited space area so that the accommodations can be retracted upwardly during "non-use" hours such as in the daytime and can be repositioned downwardly during "use" hours such as in the evening.

Turning now to FIG. 14 of the drawings, there will be described the novel steps of the applicant's method of providing resting and/or sleeping accommodations in a limited space area so that the accommodations can be repositioned as desired there providing more useable space in the limited space area.

In the first step 156 of the novel method taught by this application, a self-standing supporting structure is provided and sized to fit within the space area. The structure would have at least three downwardly positioned legs formed thereon and would have at least one retaining means formed thereon.

In the second step 158, there would be provided at least one pivotally mounted accommodation device for the supporting structure. This device could be a bed, a chair, a couch or other devices within the spirit and scope of the invention.

In the third step 160 of the novel method, the supporting structure would be positioned in a desired space area. In the fourth step 162, the accommodation device would be pivoted to the desired position upwardly or downwardly as needed.

Thereafter, in the last step 164, the accommodation device would be locked in the desired position to thereby provide increased accommodations for the space area as desired.

Figure 15:
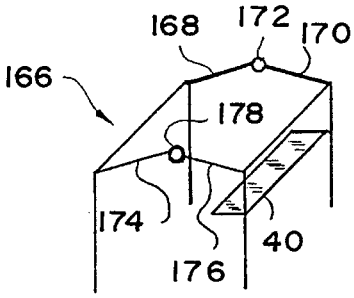
FIGS. 15–16 are diagrammatic representations of further modifications of the applicant's basic invention showing adjustable structural changes that permit the cross members of the structure to be made adjustable in order to facilitate painting or cleaning of the walls in the limited space area by moving the structure away from the walls.
Figure 16:
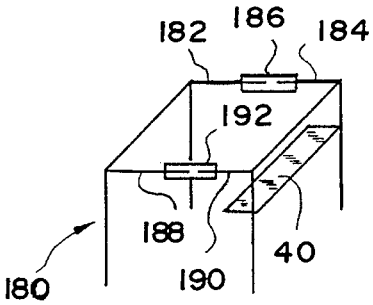

Turning now to FIGS. 15 and 16 of the drawings, there are shown modifications of the basic structure to facilitate the painting or cleaning of the walls adjacent to the legs of the structure. In the modification of FIG. 15 shown generally by the numeral 166, the cross members 168 and 170 would be connected to a hinge member 172. In a similar manner, the cross members 174 and 176 would be connected to a hinge member 178 as shown.

When constructed thusly, these members 168, 170, 172 and 174 could be pivoted upwardly or downwardly to shorten the width of the structure. This would move the legs of the structure away from the walls of the limited space area. In that way, the walls could be cleaned or painted without having to move the entire structure totally out of the space area.

In a similar manner, the modification shown generally by the numeral 180 in FIG. 16 could be used for the same purpose. In this variation, the cross members 182 and 184, could be made to slide within each other and they would be held together in a desired position by a sliding link 186. In a similar manner, the cross members 188 and 190 would be constructed similarly and would be held together by a similar sliding link 192 as shown in FIG. 16. The sliding links 186 and 192 could then be repositioned on the cross members to permit the cross members to be moved towards each other so that the width of the entire structure is shortened and the structure is made adjustable. Thereafter, the walls in the limited space area could be easily painted or cleaned.

Other design changes are possible in order to make the cross members adjustable and the entire structure shorter in width in order to facilitate cleaning/or painting of the walls in the space area. The modifications of FIGS. 15–16 are given by way of illustration only and the applicants are not to be limited to the modifications of FIGS. 16 and 16 of the drawings within the spirit and scope of the invention.

In summary, the applicant's have provided, by the unique design shown, all of the object and advantages of the invention. Nevertheless, it should become apparent that changes and modifications may be made to the basic design concept and to the various arrangement of the parts of the invention. The preferred embodiment shown as well as the modifications shown and/or described have been given by way of illustration only and the applicant is not to be limited to the embodiments shown and described.

Having described our invention, we claim:

1. A self-standing supporting structure for use in providing sleeping and/or resting accommodations in a limited and/or unlimited space area without permanently attaching supporting structural devices to the walls, to the ceiling or to the floor of the space area, the supporting structure standing on the floor of the space area and being easily moveable as desired to different locations, comprising:

(a) a free-standing frame support structure, spanning at least a portion of the space area and having a generally horizontal support means, and at least three downwardly extending legs formed on the frame support structure, with the legs resting on the floor of the space area, said support structure not being permanently attached to any walls, the floor or the ceiling of the space area (b) at least one generally rectangular accommodation device, adapted to be capable of supporting an occupant in a generally lying down position, comprising a generally rectangular frame, with two of its adjacent comer areas pivotally mounted by pivot means on two of the downwardly positioned legs so that the accommodation device may be positioned in a generally horizontal "use" position and may also be pivoted to a "non-use" position when desired; and (c) at least one retaining means, comprising two chain-like means connected to the two adjacent comer areas of the generally rectangular frame that are not pivotally mounted to the legs, and means adapted to releasably and adjustably connect the chain-like means to the generally horizontal support means to thereby permit the retaining means to retain the accomodation device in a generally horizontal use position, or a pivot non-use position.

2. The supporting structure as defined in claim 1 wherein the retaining means comprise at least one chain attached to the accommodation device and to the supporting structure and the chain is used to retain the accommodation device in a "non-use" position.

3. The supporting structure as defined in claim 1 wherein the retaining means additionally comprise at least one safety lock pivotally attached to the downwardly extending legs and fixedly attached to the accommodation device.

4. The supporting structure as defined in claim 1 wherein the retaining means comprise at least one chain and at least one safety lock attached to the accommodation device and to the supporting structure and the chain can be used to hold the accommodation device in a "non-use" position.

5. The supporting structure as defined in claim 4 wherein the retaining means comprise a pair of chains and a pair of safety locks attached to the accommodation device and to the supporting structure.

6. The supporting structure as defined in claim 1 wherein the structure has attached thereto at least two bed frames pivotally attached to the downwardly extending legs.

7. The supporting structure as defined in claim 1 wherein the structure has at least four bed frames pivotally attached to the downwardly extending legs.

8. The supporting structure as defined in claim 1 wherein the structure has at least six bed frames pivotally attached to the downwardly extending legs.

9. The self-standing support structure as defined in claim 1 wherein the free-standing frame of the structure is constructed with adjustable means which permit the structure to be compressed in width to facilitate painting and cleaning of walls in the space area.

10. The supporting structure as defined in claim 1, wherein the retaining means comprise at least one cable attached to the accommodation device and to the supporting structure and the cable is used to retain the accomodation device in a "non-use" position.

11. The structure as claimed in claim 10 wherein said pivot means further comprises a pivot pin and a pivot rest, such that the pivot rest limits the pivotal movement of the accomodation device to a "use" position that is not lower than a generally horizontal position.

12. The structure as claimed in claim 10 wherein said pivot means further comprises:

(a) a first plate, having an upper portion and a lower portion and having a hole formed through the upper portion of the plate;

(b) a second plate, fixedly attached to the lower portion of the first plate and extending approximately perpendicular to the first plate, the second plate sized to engage the downwardly extending legs of the supporting structure to thereby act as a retainer means; and (c) means, associated with the accommodation device, for fixedly attaching the accommodation device to the second plate so that the first plate and the second plate allow the accomodation device to pivotally rotate about a substantially horizontal axis.

13. A self-standing supporting structure for use in providing sleeping and/or resting accommodations in a limited or/unlimited space area without permanently attaching structural devices to walls of the space area, tile supporting structure standing on the floor of the space ,area and being moveable as desired to different locations, comprising:

(a) a free-standing frame structure, spanning at least a portion of the space area and having a generally horizontal support means and four downwardly extending legs attached to the frame structure and resting on the floor of the space area, the frame structure also having at least two cross supports sized to span across the width of the space area;

(b) at least one bed frame, adapted to be capable of supporting an occupant in a generally lying down position, comprising a generally rectangular frame, with two of its adjacent comer areas pivotally mounted on two of the downwardly positioned legs so that the accommodation device may be positioned in a generally horizontal "use" position and may also be pivoted to a "non-use" position when desired; and (c) at least one retaining means, comprising two chain-like means connected to the two adjacent comer areas of the generally rectangular frame that are not pivotally mounted to the legs, and means adapted to releasably and adjustably connect the chain-like means to the generally horizontal support means to thereby permit the retaining means to retain the accomodation device in a generally horizontal use position, or a pivotal non-use position.

14. The supporting structure as defined in claim 13 further comprising the structure having additional retainer means formed as part of a pivotal connection to serve as a safety lock to prevent the bed frame from pivoting downwardly beyond the horizontal "use" position.

15. The supporting structure as defined in claim 13 wherein the structure is constructed for easy assembly and disassembly by assembling the structure at the space area with bolts and nuts attached to mating flanges.

16. The self-standing support structure as defined in claim 13 wherein the cross supports of the structure are constructed with hinge connections which permit the structure to be compressed in width to facilitate painting and cleaning of walls in the space area.

17. The self-standing support structure as defined in claim 13 wherein the cross supports of the structure are constructed with sliding link connections which permit the structure to be compressed in width to facilitate painting and cleaning of walls in the space area.

18. A sleeping accommodations structure for use in a limited space area having walls, a ceiling and a floor and where temporary resting and/or sleeping accommodations are desired using temporary accommodation devices which are not permanently fastened to the walls or to the floor of the space area, comprising:

a self-supporting free-standing supporting structure having at least four vertical support members, two elongate horizontal support members and two cross horizontal support members, said horizontal and vertical support members adapted to be easily assembled to each other to define said supporting structure, and adapted to be easily dissassembled from each other, said supporting structure positioned on the floor of the space area against the walls and spanning the ceiling;

at least one temporary accommodation device, pivotally attached to the supporting structure and designed for supporting the occupants using the accommodation device when the device is in a horizontal "use" position said at least one accommodation device attached to said supporting structure below said elongate horizontal support members and said cross horizontal support members;

means that permit pivotal rotation about a substantially horizontal axis, pivotally attached to the supporting structure, for pivoting the accommodation device upwardly and/or downwardly as desired from a "use" position to a "non-use" position; and means, associated with the temporary accommodation device, for retaining the device in the "use" position and also in the "non-use" position as desired by the user of the accommodation device.

19. The structure as defined in claim 18 wherein the accommodation device is at least one bed.

20. The structure as defined in claim 18 wherein the accommodation device is a plurality of beds.

21. A self-standing supporting structure for use in providing resting accommodations in a space area without permanently attaching supporting structural devices to the walls, to the ceiling or to the floor of the space area, the supporting structure standing on the floor of the space area and being easily moveable as desired to different locations, comprising:

(a) a free-standing frame support structure, spanning at least a portion of the space area having at least four vertical support members, two elongate horizontal support members and two cross horizontal support members, horizontal and vertical support members adapted to be easily assembled to each other, to define said supporting structure, and adapted to be easily dissassembled from each other, said supporting structure not being permanently attached to any walls, the floor or the ceiling of the space area;

(b) at least one generally rectangular accommodation device, adapted to be capable of supporting an occupant in a generally lying down position, comprising a generally rectangular frame, said at least one accommodation device attached to said supporting structure below said elongate horizontal support members and said cross horizontal support members; with two of its adjacent corner areas pivotally mounted on two of the vertical support members so that the accommodation device may be positioned in a generally horizontal "use" position and may also be pivoted to a "non-use" position when desired; and (c) at least one retaining means, comprising at least two pivot means that permit pivotal rotation about a substantially horizontal axis, such that limited pivotal movement of the accomodation device from a "non-use" position to, but not beyond, a generally horizontal "use" position is permited, and such that the retaining means retains the accomodation device in a generally horizontal use position.

* * * * *